US011718441B2

(12) United States Patent
Ito et al.

(10) Patent No.: US 11,718,441 B2
(45) Date of Patent: Aug. 8, 2023

(54) RESIN CONTAINER

(71) Applicant: NISSEI ASB MACHINE CO., LTD., Nagano (JP)

(72) Inventors: Michihito Ito, Nagano (JP); Junji Takahashi, Nagano (JP)

(73) Assignee: NISSEI ASB MACHINE CO., LTD., Nagano (JP)

( * ) Notice: Subject to any disclaimer, the term of this patent is extended or adjusted under 35 U.S.C. 154(b) by 0 days.

(21) Appl. No.: 16/756,345

(22) PCT Filed: Oct. 18, 2018

(86) PCT No.: PCT/JP2018/038871
§ 371 (c)(1),
(2) Date: Apr. 15, 2020

(87) PCT Pub. No.: WO2019/078305
PCT Pub. Date: Apr. 25, 2019

(65) Prior Publication Data

US 2020/0324932 A1 Oct. 15, 2020

(30) Foreign Application Priority Data

Oct. 20, 2017 (JP) ..... 2017-203345

(51) Int. Cl.
*B65D 1/02* (2006.01)

(52) U.S. Cl.
CPC .... *B65D 1/0292* (2013.01); *B65D 2501/0036* (2013.01); *B65D 2501/0081* (2013.01)

(58) Field of Classification Search
CPC ..... B65D 21/08; B65D 5/005; B65D 21/086; B65D 2501/0009; B65D 2501/0018; B65D 2501/0036
(Continued)

(56) References Cited

U.S. PATENT DOCUMENTS 2,899,110 A * 8/1959 Parker ..... B65D 1/0292 222/215
4,890,757 A * 1/1990 Robbins, III ..... B65D 1/42 220/675
(Continued)

FOREIGN PATENT DOCUMENTS

AU 649954 B2 * 9/1994 ..... B65D 1/02
CN 2306191 Y 2/1999
(Continued)

OTHER PUBLICATIONS

Office Action issued in corresponding Chinese Patent Application No. 201880073767.3 dated Mar. 10, 2021, along with English Translation thereof.
(Continued)

*Primary Examiner* — Jennifer Robertson
*Assistant Examiner* — Eric C Baldrighi
(74) *Attorney, Agent, or Firm* — Greenblum & Bernstein, P.L.C.

(57) ABSTRACT

Provided is a resin container for a water server, the container including an upper surface portion where a liquid inlet and outlet portion is formed, a side surface portion connected to the upper surface portion, and a bottom surface portion disposed on a side opposite to the upper surface portion and connected to the side surface portion. A round corner surface portion is formed to the side surface portion such that the container has a polygonal shape with round corners when the container is viewed from an upper surface portion side. A wall thickness of a shoulder portion of the upper surface portion which is defined between the round corner surface portion of the side surface portion and the inlet and outlet portion is larger than a wall thickness of a portion of the upper surface portion which is adjacent to the shoulder portion.

6 Claims, 9 Drawing Sheets

(58) Field of Classification Search
USPC ..... 215/383
See application file for complete search history.

(56) References Cited

U.S. PATENT DOCUMENTS

| | | | | | |
|---|---|---|---|---|---|
| 5,217,128 | A * | 6/1993 | Stenger | B65D 1/0223 215/370 |
| 5,833,115 | A | 11/1998 | Eiten | |
| 7,699,171 | B2 * | 4/2010 | Rivera | B65D 21/0231 206/508 |
| 8,439,214 | B2 * | 5/2013 | Darr | B65D 1/0223 220/675 |
| 2004/0144747 | A1 * | 7/2004 | Saito | B65D 79/005 215/379 |
| 2005/0045645 | A1 * | 3/2005 | Tsutsui | B65D 79/005 220/669 |
| 2007/0114200 | A1 * | 5/2007 | Lane | B65D 21/0231 215/10 |
| 2015/0108081 | A1 * | 4/2015 | Boulay | B65D 79/0084 220/672 |
| 2017/0021956 | A1 * | 1/2017 | Ring | B65D 1/0223 |
| 2020/0231323 | A1 * | 7/2020 | Ito | B65D 1/0292 |

FOREIGN PATENT DOCUMENTS

| | | | | |
|---|---|---|---|---|
| CN | 101998924 | A | 3/2011 | |
| GB | 1024406 | A * | 9/1964 | |
| JP | 10-218149 | A | 8/1998 | |
| JP | 2001122237 | A * | 5/2001 | B65D 1/0292 |
| JP | 2004-42995 | | 2/2004 | |
| JP | 2008-7181 | A | 1/2008 | |
| JP | 2008007171 | A * | 1/2008 | B65D 1/0223 |
| JP | 2010-042859 | | 2/2010 | |
| JP | 2010042859 | A * | 2/2010 | B67D 3/0032 |
| JP | 2012-046216 | | 3/2012 | |
| JP | 2012046216 | A * | 3/2012 | |
| JP | 2013-124115 | A | 6/2013 | |
| JP | 2013124115 | A * | 6/2013 | |
| JP | 2016-060536 | A | 4/2016 | |
| JP | 2016060536 | A * | 4/2016 | |
| WO | 98/33712 | A1 | 8/1998 | |
| WO | WO-9833712 | A1 * | 8/1998 | B65D 1/0276 |
| WO | 2016/050977 | | 4/2016 | |
| WO | WO-2016050977 | A1 * | 4/2016 | B65D 1/0223 |

OTHER PUBLICATIONS

Official Communication (ISR) dated Dec. 11, 2018 in International Patent Application No. PCT/JP2018/038871 and English translation thereof.

Official Communication (Written Opinion) dated Dec. 11, 2018 in International Patent Application No. PCT/JP2018/038871, and English translation thereof.

Office Action issued in Corresponding Japanese Patent Application No. 2017-203345, dated Apr. 5, 2022, along with an English translation thereof.

* cited by examiner

RESIN CONTAINER

TECHNICAL FIELD

The present invention relates to a resin container for a water server.

BACKGROUND ART

In recent years, awareness of health consciousness and need to prepare for natural disasters has increased, and demand for containers referred to as bag in-box (BIB) has increased. The BIB is a composite structural container in which a resin container filled with liquid such as drinking water (mineral water) is accommodated in an exterior body such as a cardboard box or a carton. Storage and transportation are performed in a state where the resin container is accommodated in the exterior body, and when used, the resin container taken out from the exterior body is set in a dispenser (water server) and used for water supply or the like.

The resin container is, for example, a thin container formed by molding a flexible material such as polyethylene terephthalate (PET) with a blow molding machine, and has a capacity of about 5 to 15 liters. The resin container has flexibility, and is crushed by atmospheric pressure with liquid draining when used upside down on the water server. Since such a resin container is a thin container having flexibility, the resin container is particularly used as a disposable (one-way type) container that is crushed and discarded after use.

Patent Literature 1 discloses a container for a water server, which includes a belt-shaped hanging tool having flexibility in vicinity of a bottom surface thereof.

Patent Literature 2 discloses a container for a water dispenser, in which the container is crushed in an axial direction of the container by a force generated by a difference between pressure inside the container and outside air pressure with liquid draining.

CITATION LIST

Patent Literature

Patent Literature 1: JP-A-2012-46216
Patent Literature 2: WO 2016/050977

SUMMARY OF INVENTION

Technical Problem

A soft container for a water server is crushed by atmospheric pressure during use. When the container is provided with a side wall portion having round corners instead of having a complete cylindrical shape, a shoulder portion having round corners formed at the four corners of the upper surface portion located below may be inverted downward, with the neck portion of the container as a base point, during the drainage of liquid. In this case, a poor connection (neck disconnection) between the nozzle of the water server and the neck portion of the container occurs, resulting in poor drainage. Further, there is a case where the liquid remains in the inverted shoulder portion, resulting in poor drainage.

An object of the present invention is to provide a resin container for a water server which is capable of suppressing the occurrence of poor drainage in which liquid remains in the container.

Solution to Problem

The resin container according to the present invention capable of solving the above problems is a resin container for a water server, which is capable of accommodating a predetermined amount of liquid and has flexibility, the container being crushed with draining of the liquid, the container including:

an upper surface portion where a liquid inlet and outlet portion is formed;

a side surface portion connected to the upper surface portion; and a bottom surface portion disposed on a side opposite to the upper surface portion and connected to the side surface portion, in which a round corner surface portion is formed to the side surface portion such that the container has a polygonal shape with round corners when the container is viewed from the upper surface portion side, and a wall thickness of a shoulder portion of the upper surface portion which is defined between the round corner surface portion of the side surface portion and the inlet and outlet portion is larger than a wall thickness of a portion of the upper surface portion which is adjacent to the shoulder portion.

Further, in the resin container according to the present invention, it is preferable that a wall thickness of a lower shoulder portion connecting the shoulder portion and the side surface portion is smaller than a wall thickness of a portion of the side surface portion which is adjacent to the lower shoulder portion.

Further, in the resin container according to the present invention, it is preferable that a plurality of recessed portions radially extending from the inlet and outlet portion when the container is viewed from the upper surface portion side are formed on the upper surface portion.

Further, in the resin container according to the present invention, it is preferable that a folding deformation inducing portion is formed on the round corner surface portion of the side surface portion, and a depth of the recessed portion formed on the upper surface portion is deeper than a depth of the groove of the folding deformation inducing portion.

Advantageous Effects of Invention

According to the present invention, a resin container for a water server which is capable of suppressing the occurrence of poor drainage in which liquid remains in the container can be provided.

DESCRIPTION OF EMBODIMENTS

Figure 1:
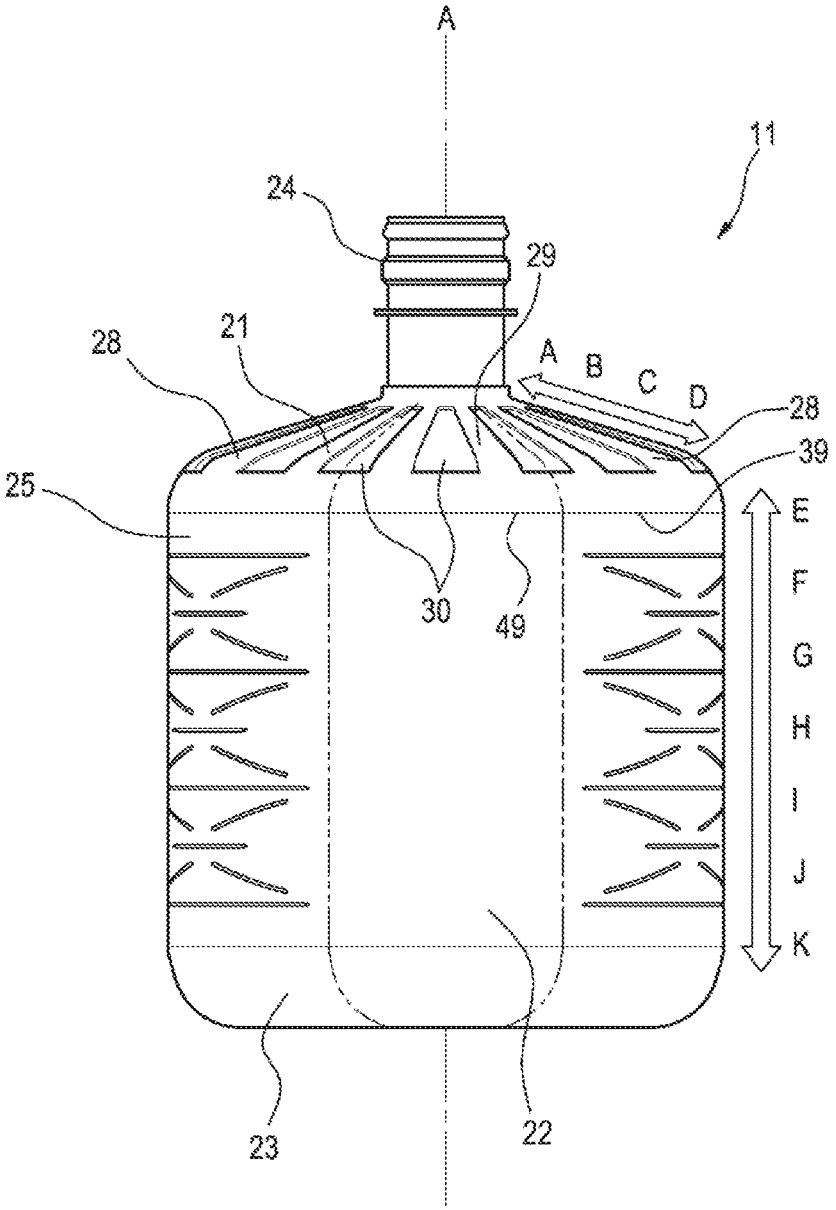
FIG. 1 is a side view showing a resin container for a water server according to a first embodiment of the present invention.

Embodiments of a resin container according to the present invention will be described below with reference to the drawings.

First Embodiment

FIGS. 1 to 4 are views showing a resin container 11 according to a first embodiment of the present invention. In the present embodiment, the resin container 11 (hereinafter, also referred to as the container 11) includes an upper surface portion 21, a side surface portion 22 connected to the upper surface portion 21, and a bottom surface portion 23 disposed on a side opposite to the upper surface portion 21 and connected to the side surface portion 22, and is formed in a substantially cubic shape. A predetermined amount of liquid (such as drinking water or the like) can be accommodated therein. The resin container 11 and a resin container 111 described later are made of, for example, a synthetic resin material such as polyester such as PET, weigh 90 to 130 g (preferably 100 to 120 g) before liquid filling, and have a filling capacity of 10 to 12 L.

The upper surface portion 21 forms a top surface of the container 11, and a cylindrical inlet and outlet portion 24 projecting upward is formed at a center thereof. Liquid is introduced into the container 11 from the inlet and outlet portion 24. The liquid in the container 11 is discharged from the inlet and outlet portion 24. A cap is attached to the inlet and outlet portion 24. The cap can be attached to and detached from the inlet and outlet portion 24, and the container 11 is sealed by attaching the cap to the inlet and outlet portion 24.

A plurality of recessed portions 30 radially extending outward from the inlet and outlet portion 24 when the container 11 is viewed from the upper surface portion 21 side are formed on the upper surface portion 21. The depth of the groove of the recessed portion 30 is formed larger than the depths of the grooves of a first folding deformation inducing portion 31 to a sixth folding deformation inducing portion 36 described later.

When the container 11 is viewed from the upper surface portion 21 side, the upper surface portion 21 of the container 11 looks like a square shape having round corners at the four corners. The upper surface portion 21 includes shoulder portions 28 formed at the four corners, respectively, and adjacent portions 29 disposed between the shoulder portions 28 at positions adjacent to the shoulder portions 28 in the circumferential direction. The shoulder portion 28 includes a first shoulder portion 28A, a second shoulder portion 28B, a third shoulder portion 28C, and a fourth shoulder portion 28D (see FIG. 3). The first shoulder portion 284 and the third shoulder portion 28C are disposed at positions facing each other with the inlet and outlet portion 24 as a center. The second shoulder portion 28B and the fourth shoulder portion 28D are disposed at positions facing each other with the inlet and outlet portion 24 as a center.

The side surface portion 22 forms a peripheral surface of the container 11, and is connected to the upper surface portion 21 and extends downward. The bottom surface portion 23 forms a bottom surface of the container 11, and is disposed on a side opposite to the upper surface portion 21 and is connected to the bottom surface portion 23.

Figure 2:
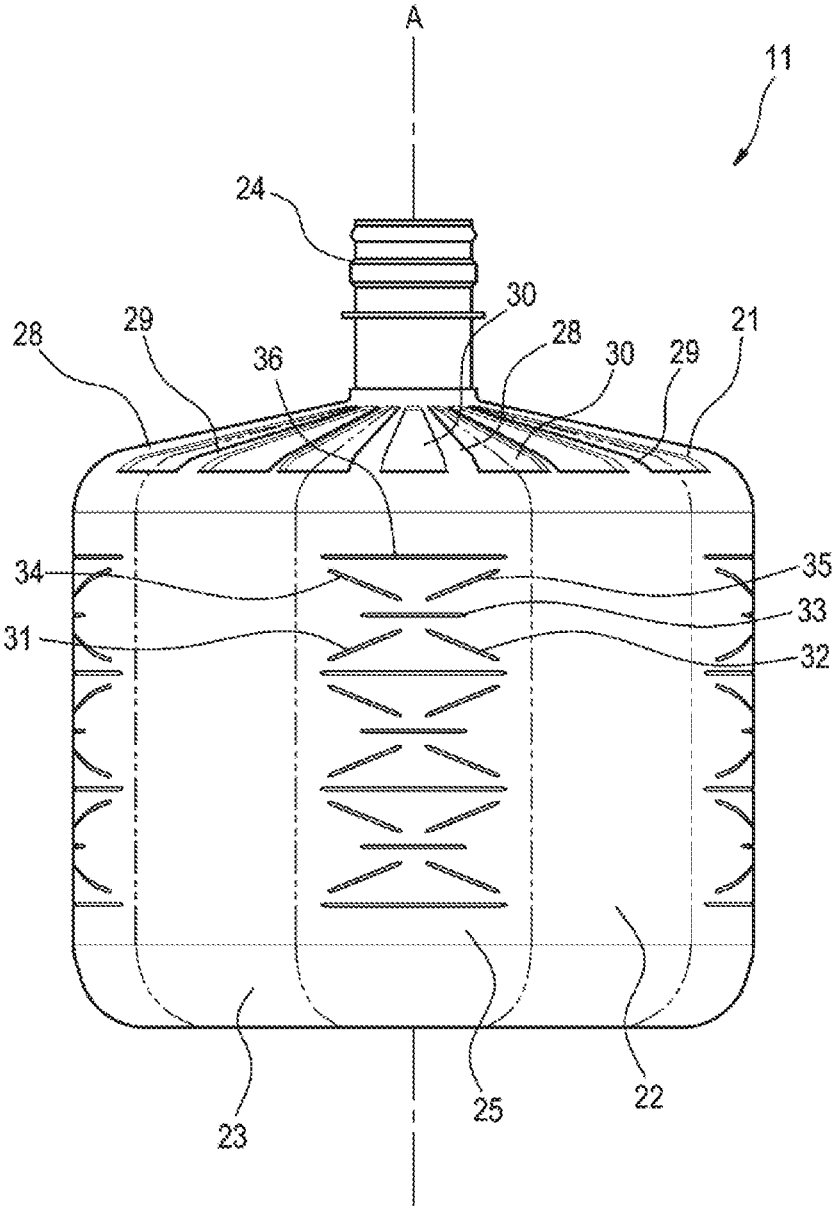
FIG. 2 is a side view showing the resin container for the water server according to the first embodiment of the present invention.
Figure 3:
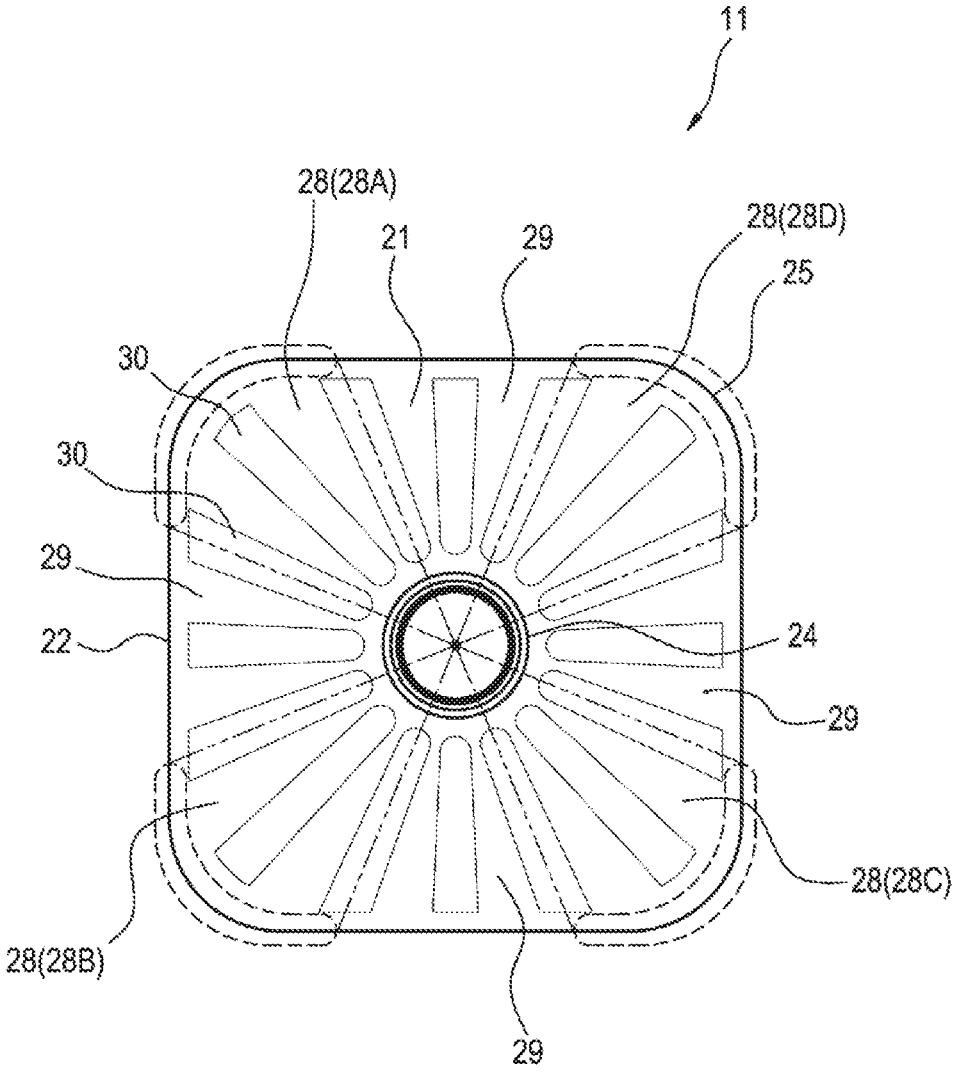
FIG. 3 is a plan view showing the resin container for the water server according to the first embodiment of the present invention.
Figure 4:
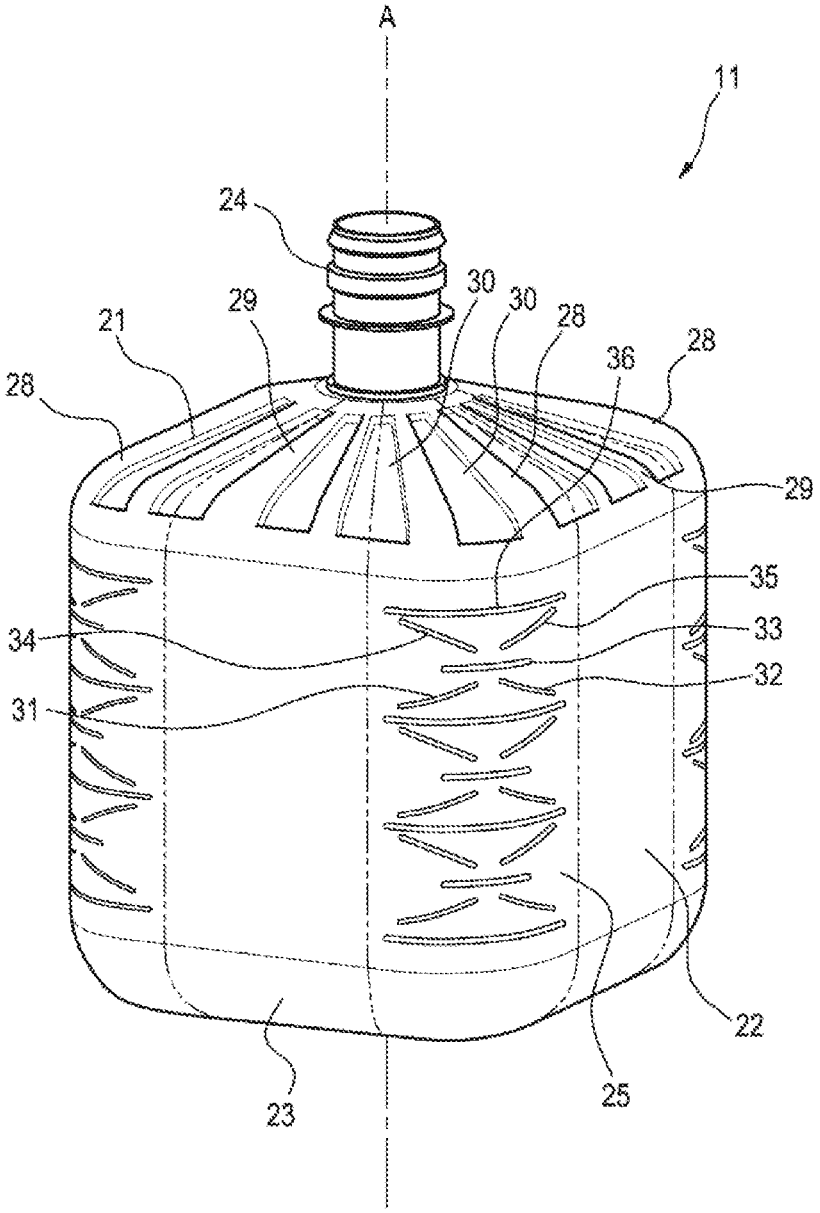
FIG. 4 is a perspective view showing the resin container for the water server according to the first embodiment of the present invention.

Round corner surface portions 25 are formed to the side surface portion 22 so that the container 11 has a square shape with round corners when the container 21 is viewed from an upper surface portion 21 side. Broken lines in FIG. 3 indicate portions corresponding to the round corner surface portions 25 in the present embodiment. As shown in FIG. 3, the round corner surface portion 25 does not refer to only the portions where round corners are formed, but extend from the portion where the round corners are formed to flat portions. Two-dot chain lines in FIGS. 1 to 4 do not indicate a three-dimensional shape, but are imaginary lines for facilitating recognition of the round corner surface portion 25.

The wall thickness of the shoulder portion 28 of the upper surface portion 21 which is defined between the round corner surface portion 25 of the side surface portion 22 and the inlet and outlet portion 24 is formed larger than the wall thickness of the adjacent portion 29 of the upper surface portion 21 which is circumferentially adjacent to the shoulder portion 28. The wall thickness of a lower shoulder portion 39, which is a boundary portion connecting the shoulder portion 28 and the side surface portion 22, is smaller than the wall thickness of an adjacent portion 49 of the side surface portion 22 which is circumferentially adjacent to the lower shoulder portion 39. The thickness distribution of each portion of the container 11 will be described later with reference to FIGS. 1 and 6.

An elongated first folding deformation inducing portion 31 is formed on the round corner surface portion 25. The first folding deformation inducing portion 31 is formed so as to be oblique with respect to a central axis A passing through the inlet and outlet portion 24 of the container 11 when the container 11 is viewed from a side surface portion 22 side such that the central axis A and the round corner surface portion 25 overlap with each other (That is, when viewed as shown in FIG. 2. Hereinafter, it is simply referred to as that the container 11 is viewed from a round corner surface portion 25 side.). The term "obliquely" as used in the present specification means that an angle is larger than 0° and smaller than 90° with respect to the central axis A, or larger than 90° and smaller than 180° with respect to the central axis A.

An elongated second folding deformation inducing portion 32 is formed on the round corner surface portion 25. The second folding deformation inducing portion 32 is formed obliquely with respect to the central axis A at an inclination different from an inclination of the first folding deformation inducing portion 31 with respect to the central axis A when the container 11 is viewed from the round corner surface portion 25 side. The second folding deformation inducing portion 32 is in a line-symmetric relationship with the first folding deformation inducing portion 31, with the central axis A as a target axis when the container 11 is viewed from the side surface portion 22 side such that the central axis A overlaps with a central line of the round corner surface portion 25.

An elongated third folding deformation inducing portion 33 is formed on the round corner surface portion 25. The third folding deformation inducing portion 33 is formed orthogonal to the central axis A at a position where the central axis A passes through a central point of the third folding deformation inducing portion 33 when the container 11 is viewed from the round corner surface portion 25 side.

An elongated fourth folding deformation inducing portion 34 and an elongated fifth folding deformation inducing portion 35 are formed on the round corner surface portion 25 in a line-symmetric relationship with the first folding deformation inducing portion 31 and the second folding deformation inducing portion 32 respectively with the third folding deformation inducing portion 33 as a symmetry axis when the container 11 is viewed from the round corner surface portion 25 side.

An elongated sixth folding deformation inducing portion 36 longer than the third folding deformation inducing portion 33 is formed on the round corner surface portion 25 so as to sandwich the first folding deformation inducing portion 31 to the fifth folding deformation inducing portion 35 and so as to be orthogonal to the central axis A when the container 11 is viewed from the round corner surface portion 25 side.

It is desirable that an annular uneven rib or bellows is not formed on the body portion immediately below the shoulder portion 28 (the lower shoulder portion 39) formed by the round corner surface portion 25 and the side surface portion 22. In other words, it is desirable that the sixth folding deformation inducing portion 36 is not formed so as to be annularly connected immediately below the shoulder portion 28. If the sixth folding deformation inducing portion 36 is connected to form an annular uneven rib or bellows, a wrinkle is formed immediately below the shoulder portion 28 along the uneven rib or bellows at the final stage of drainage, and the shoulder portion 28 is in a stretched state. As a result, the crush resistance is increased and poor drainage is likely to occur. The same applies to the third folding deformation inducing portion 133*d* and the seventh folding deformation inducing portion 137*d* in a second embodiment described later. Further, it is desirable that the depths in the inner diameter direction of the sixth folding deformation inducing portion 36 and the seventh folding deformation inducing portion 137*d* immediately below the shoulder portion 28 are formed shallower than the depths in the inner diameter direction of the sixth folding deformation inducing portion 36, the third folding deformation inducing portions 133*a*, 133*b*, and 133*c*, and the seventh folding deformation inducing portions 137*a*, 137*b*, and 137*c* located on the side of the bottom surface portion 23 than each inducing portion immediately below the shoulder portion 28. Thereby, the stretched state that may occur immediately below the shoulder portion 28 in the final stage of drainage can be further reduced.

The first folding deformation inducing portion 31 to the sixth folding deformation inducing portion 36 are respectively recessed portions provided on the round corner surface portion 25. Three units, each of which is formed by the first folding deformation inducing portion 31 to the sixth folding deformation inducing portion 36, are formed on the round corner surface portion 25 side by side in a direction of the central axis A.

Figure 5A:
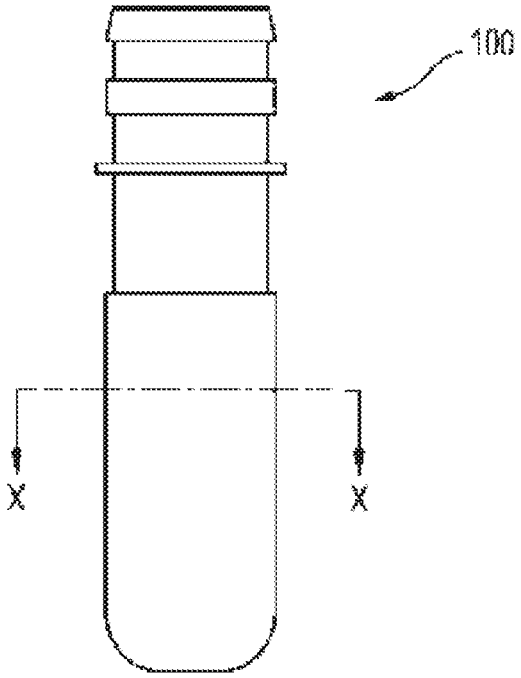
FIG. 5A is a side view of a preform used for manufacturing the resin container for the water server according to the first embodiment of the present invention.
Figure 5B:
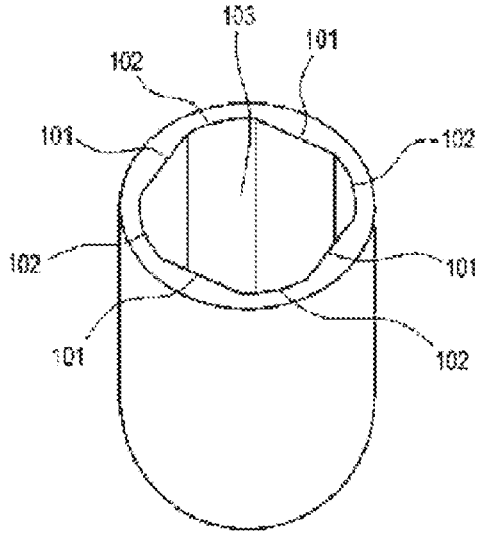
FIG. 5B is a perspective view showing a cross section of the preform viewed from the direction of arrow X-X in FIG. 5A.

FIGS. 5A and 5B are views showing a preform 100 for manufacturing the container 11. FIG. 5A is a side view of the preform 100, and FIG. 5B is a view showing a cross section of the preform 100 viewed from the direction of arrow X-X in FIG. 5A.

As shown in FIGS. 5A and 5B, the preform 100 has a hollow cylindrical shape with a bottom. The inner wall surface defining a hollow portion 103 includes four flat portions 101 and arc portions 102 connecting each flat portion 101. The four flat portions 101 forming the inner wall surface of the hollow portion 103 are formed by using a core obtained by chamfering four places with respect to a circular shape in a top view (hereinafter, also referred to as a 4-chamfered injection core) during injection molding. Using a four-station type (preform injection molding, temperature adjustment treatment, blow molding, container taking-out) manufacturing apparatus, the preform 100 is injection-molded using a 4-chamfered injection core, and after temperature adjustment, blow molding is performed under predetermined conditions, whereby it becomes easy to manufacture the container 11 having the intended thickness distribution.

In general, in the hot parison type blow molding method, the thin portion of the preform tends to have less residual heat (the temperature is easily lowered) than the thick portion and tends to be difficult to be stretched. Thus, the portion corresponding to the thin portion of the preform is easily thickened in the container after the blow molding. In the present invention, since the preform 100 is provided with the relatively thin four arc portions 102, the shoulder portion 28 and the upper portion of the round corner surface portion 25 located in the diagonal direction (the direction of the round corner surface portion 25) of the resin container 11 and the resin container 111 described later are relatively thickened and the rigidity of the shoulder portion 28 can be increased.

Thereby, the inverted deformation of the shoulder portion 28 due to drainage is suppressed, and poor drainage can be reduced. In addition, the four flat portions 101 relatively thickened by the preform 100 are appropriately stretched, and the body portions of the resin containers 11 and 111 (the lower portions of the side surface portions 22 and the round corner surface portions 25) are formed to be relatively thin. Due to the difference in the stretch amount based on the difference in the residual heat between the four arc portions 102 and the four flat portions 101, the circumferential wall thicknesses of the body portions of the resin containers 11 and 111 are made thin and uniform. Therefore, by employing the above-described preform 100, the shoulder portion 28 whose rigidity is desired to be increased can be thickened and the body portion (the lower portions of the side surface portion 22 and the round corner surface portion 25) whose rigidity is desired to be suppressed can be thinned, and thus, it is possible to provide the resin containers 11 and 111 with an efficient thickness distribution while suppressing the amount of resin. In order to selectively increase the wall thickness of the shoulder portions 28 of the resin containers 11 and 111, the temperature of a lower part of a body portion of the preform 100 may be adjusted to be higher than the temperature of an upper part of the body portion of the preform 100 by a temperature adjustment treatment.

Figure 6:
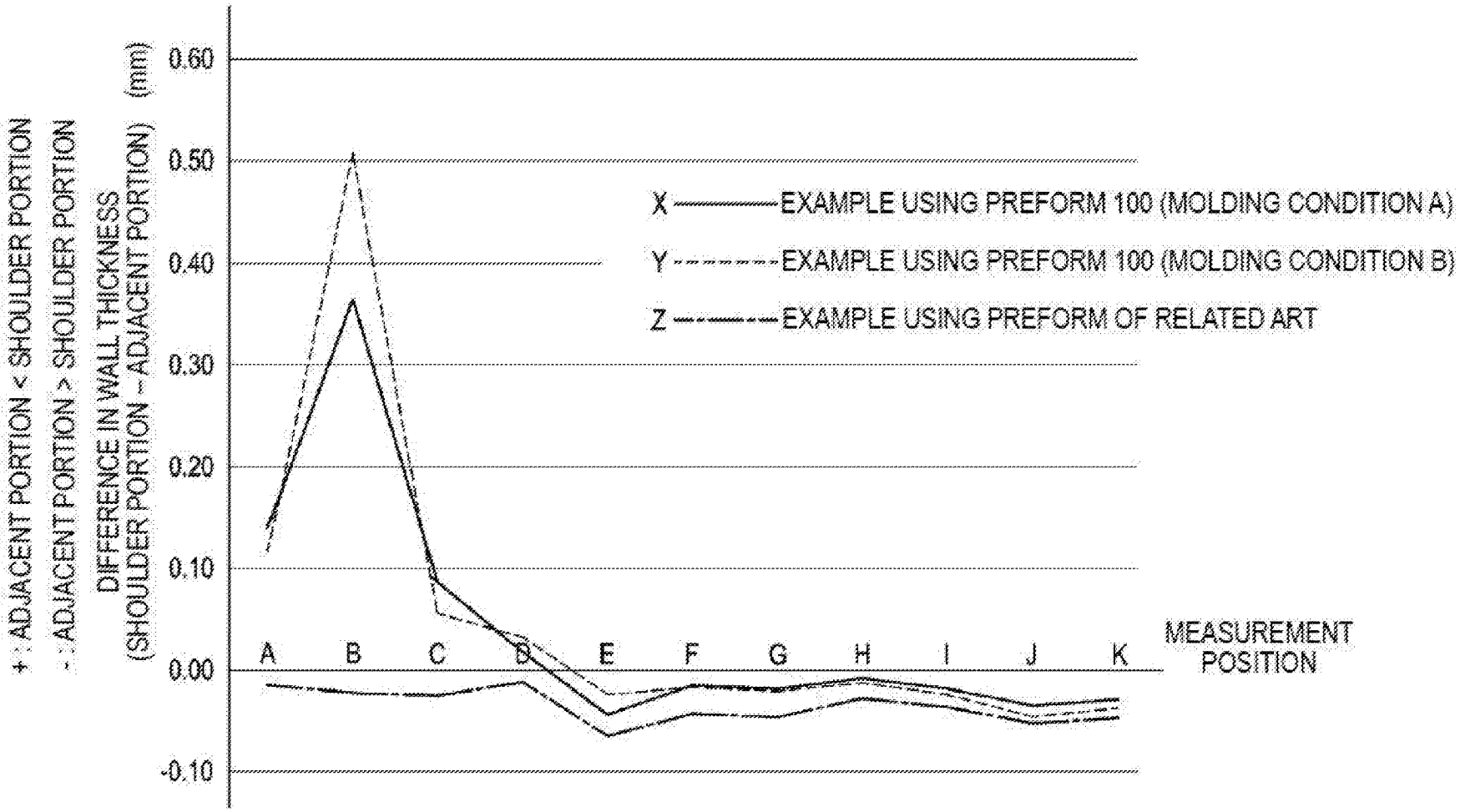
FIG. 6 is a graph showing a thickness distribution of the resin container for the water server according to the first embodiment of the present invention.

Next, the thickness distribution of the container 11 will be described with reference to FIGS. 1 and 6. The horizontal axis of the graph in FIG. 6 indicates the position at which the wall thickness of the container 11 was measured, and corresponds to the reference signs A to K shown in FIG. 1. The vertical axis of the graph in FIG. 6 indicates a difference value of the wall thickness between the shoulder portion 28 and the adjacent portion 29 at a predetermined measurement position.

In the example of line graph X and the example of line graph Y, the above-described preform 100 is used. The difference between the example of the graph X and the example of the graph Y is a molding condition of blow molding, and parameters such as a blow pressure and time are adjusted to obtain the desired thickness distribution. In both the example of the graph X and the example of the graph Y, at the measurement position B, the graph shows a peak in the positive direction in the positive region. These peaks indicate that the wall thickness of the shoulder portion 28 is larger than the wall thickness of the adjacent portion 29 at the height of the measurement position B. In addition, these peaks show the maximum values at the measurement position B, and also indicate that the difference between the wall thickness of the shoulder portion 28 and the wall thickness of the adjacent portion 29 at the measurement position B is larger than those at other measurement positions. Meanwhile, in the example of graph Z, a preform (a preform whose wall thickness is substantially constant in the circumferential direction) which is injection-molded using a normal injection core without chamfering is used, and no positive peak is shown in the positive region at any of the measurement positions A to D corresponding to the shoulder portions 28.

At the measurement position E, in both the example of the line graph X and the example of the line graph Y, the graph shows a negative peak in a negative region. This indicates that the wall thickness of the lower shoulder portion 39, which is a boundary portion connecting the shoulder portion 28 and the side surface portion 22, is smaller than the wall thickness of the portion 49 circumferentially adjacent to the lower shoulder portion 39. Further, it is indicated that the wall thickness of the lower shoulder portion 39, which is a boundary portion connecting the shoulder portion 28 and the side surface portion 22, is smaller than those of the portions at the measurement positions (D and F) vertically adjacent thereto.

At the measurement positions F to K, in both the example of the line graph X and the example of the line graph Y, the value fluctuates near zero. This indicates that at each height of the measurement positions F to K, the wall thickness of the shoulder portion 28 and the wall thickness of the portion adjacent thereto in the circumferential direction are substantially uniform in the circumferential direction. That is, it is indicated that the body portion of the side surface portion 22 of the container 11 has a substantially uniform wall thickness as a whole.

As described above, according to the resin container 11 of the present embodiment, the wall thickness of the shoulder portion 28 of the upper surface portion 21 which is defined between the round corner surface portion 25 of the side surface portion 22 and the inlet and outlet portion 24 is formed larger than the wall thickness of the adjacent portion 29 of the upper surface portion 21 which is circumferentially adjacent to the shoulder portion 28, and the strength of the shoulder portion 28 is reinforced. For this reason, when the resin container 11 is used on a water server with the top and bottom turned upside down, the shoulder portion 28 having the round corners formed at the four corners of the upper surface portion 21 is difficult to be inverted with respect to the inlet and outlet portion 24 of the container 11 as a base point in the process where the container is crushed by the atmospheric pressure during the drainage of the liquid, whereby the original shape is maintained. For this reason, poor connection (neck disconnection) between the nozzle of the water server and the inlet and outlet portion 24 of the container 11 is less likely to occur, and the liquid is less likely to remain in the inverted shoulder portion 28.

As described above, according to the above configuration, it is possible to provide the resin container 11 for a water server, which is capable of suppressing the occurrence of poor drainage in which the liquid remains in the container 11.

In the resin container 11 of the present embodiment, the wall thickness of the lower shoulder portion 39 connecting the shoulder portion 28 and the side surface portion 22 is smaller than the wall thickness of the portion 49 of the side surface portion 22 which is circumferentially adjacent to the lower shoulder portion 39.

According to this configuration, in the process where the container 11 is crushed by the atmospheric pressure during the drainage of the liquid, the container 11 becomes easily crushed smoothly up to the lower shoulder portion 39 of the side surface portion 22, and further, the liquid in the container 11 is difficult to remain.

In the resin container 11 of the present embodiment, a plurality of recessed portions 30 radially extending outward from the inlet and outlet portion 24 when the container 11 is viewed from the upper surface portion 21 side are formed on the upper surface portion 21.

According to this configuration, the strength of the entire upper surface portion 21 including the shoulder portion 28 is further reinforced. For this reason, when the resin container 11 is used on a water server with the top and bottom turned upside down, the shoulder portion 28 having the round corners formed at the four corners of the upper surface portion 21 is less likely to be inverted with respect to the container 11 as a base point in the process where the container 11 is crushed by the atmospheric pressure during the drainage of the liquid, whereby the original shape is easily maintained.

In the resin container 11 of the present invention, the first folding deformation inducing portion 31 to the sixth folding deformation inducing portion 36 are formed on the round corner surface portion 25 of the side surface portion 22, and the depth of the recessed portion 30 formed on the upper surface portion 21 is deeper than the depth of the grooves of the first folding deformation inducing portion 31 to the sixth folding deformation inducing portion 36.

According to this configuration, in the process where the container 11 is crushed by the atmospheric pressure during the drainage of the liquid, the first folding deformation inducing portion 31 to the sixth folding deformation inducing portion 36 can easily crush the container 11 smoothly up to the lower shoulder portion 39 of the side surface portion 22, and the strength of the shoulder portion 28 can be reinforced by the recessed portion 30 extending radially on the upper surface portion 21.

The container 11 is put into a box-shaped accommodation portion provided at an upper portion of a water dispenser in a state of being upside down. In this state, water, which is liquid inside, is supplied to the water dispenser form the inlet and outlet portion 24 of the container 11.

When the water in the container 11 decreases as being consumed by the water dispenser, the soft resin container 11 having flexibility is deformed and the volume thereof is reduced accordingly. Therefore, air does not enter the container 11 with the decrease in water, thereby ensuring hygiene. At this time, the folding deformation inducing portions 31 to 36 on the round corner surface portion 25 of the side surface portion 22 serving as the peripheral surface are easily deformed with the decrease in water.

In the present embodiment, the first folding deformation inducing portion 31 recessed inward of the container 11 is provided on the round corner surface portion 25. The first folding deformation inducing portion 31 is likely to become a starting point of folding deformation and the round corner surface portion 25 of the side surface portion 22 of the container 11 can be prevented from becoming a support, and thus the container 11 can be crushed such that no liquid remains in the container 11. More specifically, a force applied to the container 11 in an irregular direction with liquid draining is induced by the first folding deformation inducing portion 31, so that the round corner surface portion 25 of the side surface portion 22 of the container 11 can be prevented from becoming a support. As a result, the container 11 can be crushed such that no liquid remains in the container 11. The irregular force is considered to be generated due to flow of water, minute variations in the thickness of the container 11 generated during molding, minute scratches and distortions on the container 11 and the like during transportation or the like. In the container 11 according to the present embodiment, regardless of the state of the container 11, the container 11 can be crushed such that no liquid remains in the container 11.

In the present embodiment, the second folding deformation inducing portion 32 recessed inward of the container 11 is further provided on the round corner surface portion, and a starting point of folding deformation is provided in conjunction with that of the first folding deformation inducing portion 31. The first folding deformation inducing portion 31 and the second folding deformation inducing portion 32 are provided in different directions from each other, whereby a force applied to the container 11 in an irregular direction can be induced such that the round corner surface portion 25 of the side surface portion 22 of the container 11 does not further become a support.

In the present embodiment, the third folding deformation inducing portion 33 recessed inward of the container 11 is further provided on the round corner surface portion 25, and a starting point of folding deformation is provided in conjunction with those of the first folding deformation inducing portion 31 and the second folding deformation inducing portion 32. In addition to the first folding deformation inducing portion 31 and the second folding deformation inducing portion 32 provided in different directions from each other, the third folding deformation inducing portion 33 is provided so as to be orthogonal to the central axis A. Thereby, a force applied to the container 11 in an irregular direction can be induced such that the round corner surface portion 25 of the side surface portion 22 of the container 11 does not further become a support and the round corner surface portion 25 is folded and deformed inward.

In the present embodiment, the fourth folding deformation inducing portion 34 to the sixth folding deformation inducing portion 36 that are recessed inward of the container 11 are further provided on the round corner surface portion 25, and thus a region for inducing folding deformation is provided. Since the folding deformation can be induced by the region, a force applied to the container 11 in an irregular direction can be induced in a wide range.

In the present embodiment, three regions for inducing the above-described folding deformation are provided on the round corner surface portion 25 in the direction of the central axis A. Thereby, a force applied to the container 11 in an irregular direction can be induced in a wide range with respect to the direction of the central axis A.

Second Embodiment

Figure 7:
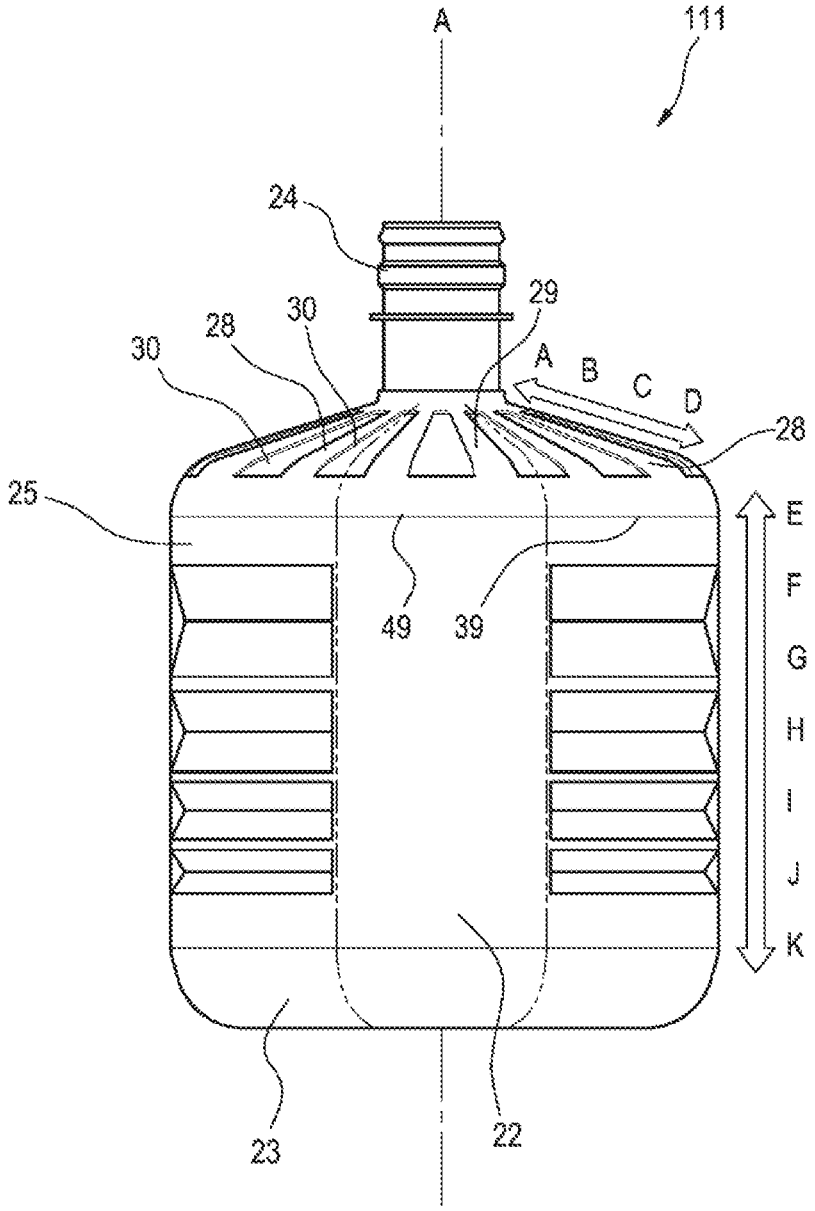
FIG. 7 is a side view showing a resin container for a water server according to a second embodiment of the present invention.
Figure 8:
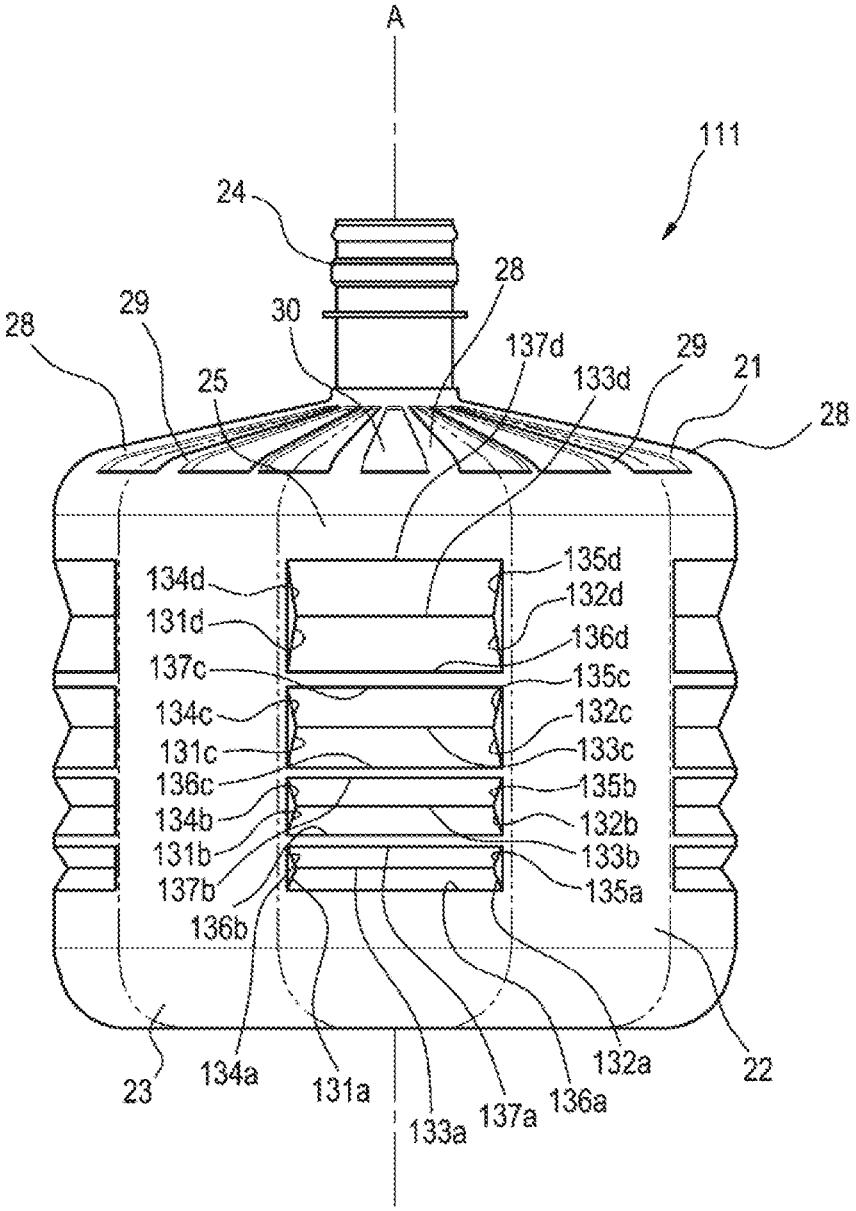
FIG. 8 is a side view showing the resin container for the water server according to the second embodiment of the present invention.
Figure 9:
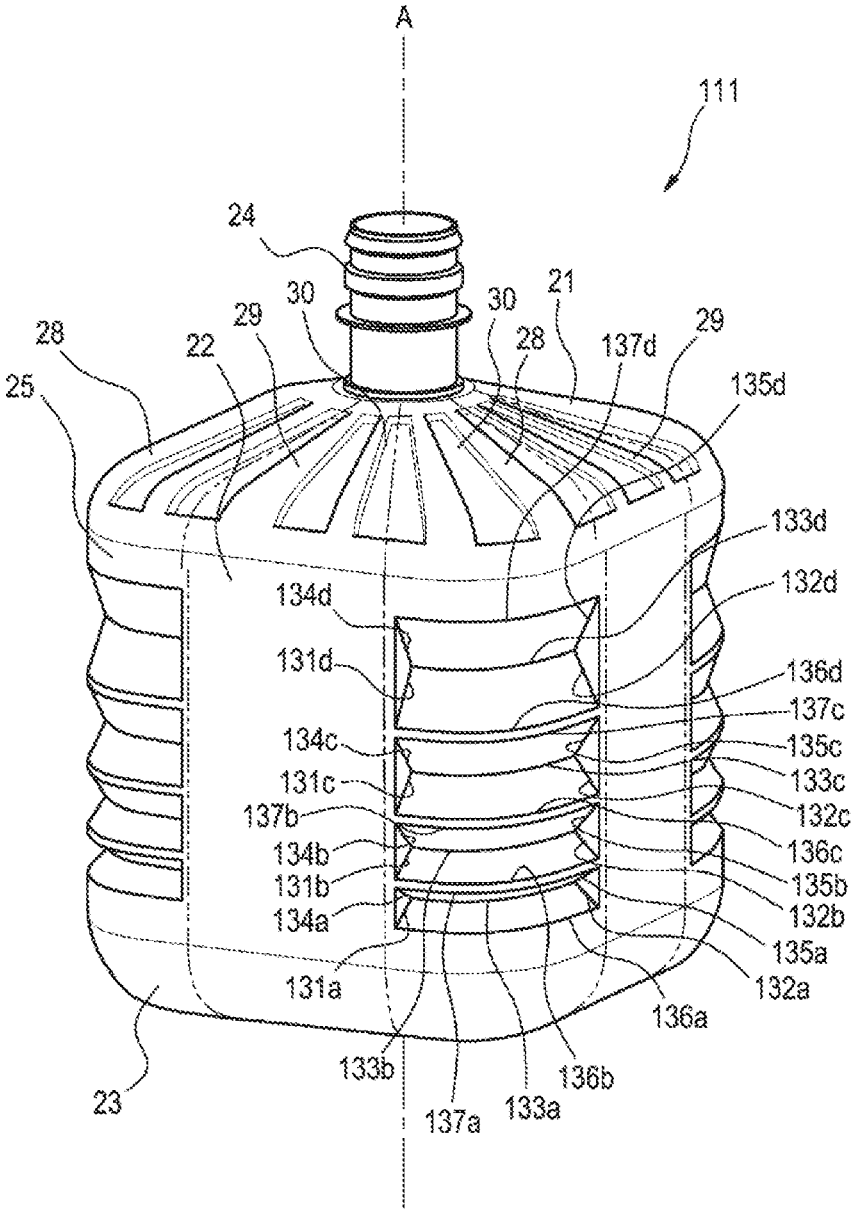
FIG. 9 is a perspective view showing the resin container for the water server according to the second embodiment of the present invention.

FIGS. 7 to 9 are views showing a resin container 111 according to a second embodiment of the present invention. The resin container 111 according to the present embodiment is similar to the resin container 11 according to the first embodiment except that a folding deformation inducing portion formed on the round corner surface portion 25 is different. Two-dot chain lines in FIGS. 7 to 9 do not indicate a three-dimensional shape, but are imaginary lines for facilitating recognition of the round corner surface portion 25.

In the present embodiment, elongated first folding deformation inducing portions 131 (131*a*, 131*b*, 131*c*, and 131*d* are collectively referred to as 131) are formed on the round corner surface portion 25. The first folding deformation inducing portion 131 is formed obliquely with respect to the central axis A passing through the inlet and outlet portion 24 of the container 111 when the container 111 is viewed from a side surface portion 22 side such that the central axis A and the round corner surface portion 25 overlap with each other (That is, when viewed as shown in FIG. 8. Hereinafter, it is simply referred to that the container 111 is viewed from a round corner surface portion 25 side.).

Elongated second folding deformation inducing portions 132 (132*a*, 132*b*, 132*c* and 132*d* are collectively referred to as 132) are formed on the round corner surface portion 25. The second folding deformation inducing portion 132 is formed obliquely with respect to the central axis A at an inclination different from an inclination of the first folding deformation inducing portion 131 with respect to the central axis A when the container 111 is viewed from the round corner surface portion 25 side. The second folding deformation inducing portion 132 is in a line-symmetric relationship with the first folding deformation inducing portion 131, with the central axis A as a target axis when the container 111 is viewed from the side surface portion 22 side such that the central axis A overlaps with a central line of the round corner surface portion 25.

Elongated third folding deformation inducing portions 133 (133*a*, 133*b*, 133*c* and 133*d* are collectively referred to as 133) are formed on the round corner surface portion 25. The third folding deformation inducing portion 133 is formed orthogonal to the central axis A at a position where the central axis A passes through a central point of the third folding deformation inducing portion 133 when the container 11 is viewed from the round corner surface portion 25 side. The first folding deformation inducing portion 131, the second folding deformation inducing portion 132 and the third folding deformation inducing portion 133 are formed continuously.

Elongated fourth folding deformation inducing portions 134 (134*a*, 134*b*, 134*c* and 134*d* are collectively referred to as 134) and elongated fifth folding deformation inducing portions 135 (135*a*, 135*b*, 135*c* and 135*d* are collectively referred to as 135) are formed on the round corner surface portion 25 in a line-symmetric relationship with the first folding deformation inducing portions 131 and the second folding deformation inducing portions 132 respectively with the third folding deformation inducing portions 133 as symmetry axes when the container 111 is viewed from the round corner surface portion 25 side. The third folding deformation inducing portion 133, the fourth folding deformation inducing portion 134 and the fifth folding deformation inducing portion 135 are formed continuously.

Elongated sixth folding deformation inducing portions 136 (136*a*, 136*b*, 136*c* and 136*d* are collectively referred to as 136) and elongated seventh folding deformation inducing portions 137 (137*a*, 137*b*, 137*c* and 137*d* are collectively referred to as 137) that are longer than the third folding deformation inducing portions 133 are formed on the round corner surface portion 25 so as to sandwich the first folding deformation inducing portions 131 to the fifth folding deformation inducing portions 135 and so as to be orthogonal to the central axis A when the container 111 is viewed from the round corner surface portion 25 side. The first folding deformation inducing portion 131, the second folding deformation inducing portion 132 and the sixth folding deformation inducing portion 136 are formed continuously. The fourth folding deformation inducing portion 134, the fifth folding deformation inducing portion 135 and the seventh folding deformation inducing portion 137 are formed continuously.

The first folding deformation inducing portion 131 and the second folding deformation inducing portion 132 are formed so as to be directed inward of the container 111 as they extend from end portions of the sixth folding deformation inducing portion 136 side toward end portions of the third folding deformation inducing portion 133. The fourth folding deformation inducing portion 134 and the fifth folding deformation inducing portion 135 are formed so as to be directed inward of the container 111 as they extend from end portions of the seventh folding deformation inducing portion 137 toward the end portions of the third folding deformation inducing portion 133. Four units, each of which is formed by the first folding deformation inducing portion 131 to the seventh folding deformation inducing portion 137, are formed side by side in the direction of the central axis A, on the round corner surface portion 25.

A trapezoid, in which the first folding deformation inducing portion 131 and the second folding deformation inducing portion 132 serve as legs, the third folding deformation inducing portion 133 serves as an upper base and the sixth folding deformation inducing portion 136 serves as a lower base, can be seen on the round corner surface portion 25 when the container 111 is viewed from the round corner surface portion 25 side. A trapezoid, in which the fourth folding deformation inducing portion 134 and the fifth folding deformation inducing portion 135 serve as legs, the seventh folding deformation inducing portion 133 serves as an upper base and the third folding deformation inducing portion 133 serves as a lower base, can be seen on the round corner surface portion 25 when the container 111 is viewed from the round corner surface portion 25 side.

In a first unit formed by the first folding deformation inducing portion 131*a* to the seventh folding deformation inducing portion 137*a* that are closest to the bottom surface portion 23 of the container 111, two trapezoids symmetrical with respect to the third folding deformation inducing portion 133*a* as a target axis are formed when the container 111 is viewed from the round corner surface portion 25 side. In a second unit formed by the first folding deformation inducing portion 131*b* to the seventh folding deformation inducing portion 137*b* that are the second closest to the bottom surface portion 23 of the container 111, similar two trapezoids are formed. In a third unit formed by the first folding deformation inducing portion 131*c* to the seventh folding deformation inducing portion 137*c* that are the third closest to the bottom surface portion 23 of the container 111, similar two trapezoids are formed. In a fourth unit formed by the first folding deformation inducing portion 131*d* to the seventh folding deformation inducing portion 137*d* that are the fourth closest to the bottom surface portion 23 of the container 11, similar two trapezoids are formed. The height of the trapezoids seen in each unit increases from a bottom surface portion 23 side toward an upper surface portion 21 side.

In the present embodiment, on the round corner surface portion 25, the first folding deformation inducing portion 131, which is directed inward of the container 111 as extending from an end portion of the sixth folding deformation inducing portion 136 side toward an end portion of the third folding deformation inducing portion 133, is likely to be a starting point of folding deformation. Thereby, the round corner surface portion 25 of the container 111 can be prevented from becoming a support, and thus the container 111 can be crushed such that no liquid remains in the container 111. More specifically, a force applied to the container 111 in an irregular direction with liquid draining is induced by the first folding deformation inducing portion 131, so that the round corner surface portion 25 of the container 111 can be prevented from becoming a support. As a result, the container 111 can be crushed such that no liquid remains in the container 111. The irregular force is considered to be generated due to flow of water, minute variations in the thickness of the container 111 generated during molding, minute scratches and distortions on the container 11 and the like during transportation or the like. In the container 111 according to the present embodiment, regardless of such state of the container 111, the container 111 can be crushed such that no liquid remains in the container 111.

In the present embodiment, the second folding deformation inducing portion 132, which is directed inward of the container 111 as it extends from an end portion of the sixth folding deformation inducing portion 136 toward an end portion of the third folding deformation inducing portion 133, is further provided on the round corner surface portion 25, and a starting point of folding deformation is provided in conjunction with that of the first folding deformation inducing portion 131. The first folding deformation inducing portion 131 and the second folding deformation inducing portion 132 are provided in different directions from each other, whereby a force applied to the container 111 in an irregular direction can be induced such that the round corner surface portion 25 of the container 111 does not further become a support.

In the present embodiment, the third folding deformation inducing portion 133 is further provided inward of the container 111 than the sixth folding deformation inducing portion 136, and a starting point of folding deformation is provided in conjunction with those of the first folding deformation inducing portion 131 and the second folding deformation inducing portion 132. In addition to the first folding deformation inducing portion 131 and the second folding deformation inducing portion 132 provided in different directions from each other, the third folding deformation inducing portion 133 is provided so as to be orthogonal to the central axis A. Thereby, a force applied to the container 111 in an irregular direction can be induced such that the round corner surface portion 25 of the container 111 does not further become a support and the round corner surface portion 25 is folded and deformed inward.

In the present embodiment, the fourth folding deformation inducing portion 134 and the fifth folding deformation inducing portion 135, which are directed inward of the container 111 as they extend from end portions of the seventh folding deformation inducing portion 137 toward end portions of the third folding deformation inducing portion 133, are further provided on the round corner surface portion 25. A region for inducing folding deformation is provided by the first folding deformation inducing portion 131 to the seventh folding deformation inducing portion 137. Since the folding deformation can be induced by the region, a force applied to the container 111 in an irregular direction can be induced in a wide range.

In the present embodiment, four regions for inducing the above-described folding deformation are provided on the round corner surface portion 25 in the direction of the central axis A. Thereby, a force applied to the container 111 in an irregular direction can be induced in a wide range with respect to the direction of the central axis A.

In the resin container 111 for a water server, the side surface portion 22 on the bottom surface portion 23 side is crushed before the side surface portion 22 on the upper surface portion 21 side when the liquid in the container 111 is drained. By reducing the height of the trapezoid seen in the first unit closest to the bottom surface portion 23 of the container 111, deformation of the container 111 can be easily induced at the beginning of liquid draining, and the round corner surface portion 25 of the container 111 can be prevented from becoming a support. When the liquid draining proceeds, since support by the liquid is lost as the liquid inside decreases, the vertical length of the deformation of the container 111 often increases. By increasing the height of the trapezoid seen in each unit toward the upper surface portion 21 side of the container 111, deformation of the container 111 is easily induced also at the middle and end of the liquid draining, and the round corner surface portion 25 of the container 111 can be prevented from becoming a support.

In the first embodiment described above, a trapezoid, in which the first folding deformation inducing portion 31 and the second folding deformation inducing portion 32 serve as legs, an imaginary line connecting end portions of the first folding deformation inducing portion 31 and the second folding deformation inducing portion 32 on a third folding deformation inducing portion 33 side serves as an upper base and an imaginary line connecting end portions of the first folding deformation inducing portion 31 and the second folding deformation inducing portion 32 on a sixth folding deformation inducing portion 36 side serves as a lower base, can be seen on the round corner surface portion 25 when the container 11 is viewed from the round corner surface portion 25 side. In addition, a trapezoid, in which the fourth folding deformation inducing portion 34 and the fifth folding deformation inducing portion 35 serve as legs, an imaginary line connecting end portions of the fourth folding deformation inducing portion 34 and the fifth folding deformation inducing portion 35 on the sixth folding deformation inducing portion 36 side serves as an upper base and an imaginary line connecting end portions of the fourth folding deformation inducing portion 34 and the fifth folding deformation inducing portion 35 on the third folding deformation inducing portion 33 side serves as a lower base, can be seen on the round corner surface portion 25 when the container 11 is viewed from the round corner surface portion 25 side. That is, two trapezoids can be seen in one unit formed by the first folding deformation inducing portion 31 to the sixth folding deformation inducing portion 36.

Also in the first embodiment, the first folding deformation inducing portion 31 to the sixth folding deformation inducing portion 36 may be formed such that the height of the trapezoid seen in each unit increases from the bottom surface portion 23 side toward the upper surface portion 21 side. By reducing the height of the trapezoid seen in the unit closest to the bottom surface portion 23 of the container 11, deformation of the container 11 can be easily induced at the beginning of liquid draining, and the round corner surface portion 25 of the container 11 can be prevented from becoming a support. By increasing the height of the trapezoid seen in each unit toward the upper surface portion 21 side of the container 11, deformation of the container 11 is easily induced also at the middle and end of the liquid draining, and the round corner surface portion 25 of the container 11 can be prevented from becoming a support.

As described above, according to the embodiment, a resin container for a water server which is capable of preventing liquid from remaining in the container can be provided.

Further, according to the resin container 111 of the present embodiment, similarly to the resin container 11 of the first embodiment, the wall thickness of the shoulder portion 28 of the upper surface portion 21 which is defined between the round corner surface portion 25 of the side surface portion 22 and the inlet and outlet portion 24 is formed larger than the wall thickness of the adjacent portion 29 of the upper surface portion 21 which is circumferentially adjacent to the shoulder portion 28, and the strength of the shoulder portion 28 is reinforced. For this reason, when the resin container 11 is used on a water server with the top and bottom turned upside down, the shoulder portion 28 having the round corners formed at the four corners of the upper surface portion 21 is difficult to be inverted with respect to the inlet and outlet portion 24 of the container 11 as a base point in the process where the container 11 is crushed by the atmospheric pressure during the drainage of the liquid, whereby the original shape is maintained. For this reason, poor connection (neck disconnection) between the nozzle of the water server and the inlet and outlet portion 24 of the container 11 is less likely to occur, and the liquid is less likely to remain on the inverted shoulder portion 28.

As described above, according to the above configuration, it is possible to provide the resin container 11 for a water server, which is capable of suppressing the occurrence of poor drainage in which the liquid remains in the container 11.

The present invention is not limited to the above-described embodiments, and modifications, improvements and the like can be made as appropriate. In addition, the material, shape, size, number, arrangement position and the like of each component in the above-described embodiments are optional and are not limited as long as the present invention can be achieved.

Also, while the present invention has been described in detail and with reference to specific embodiments, it will be apparent to those skilled in the art that various changes and modifications can be made without departing from the spirit and scope of the invention.

The present application is based on Japanese Patent Application No. 2017-203345 filed on Oct. 20, 2017, the contents of which are incorporated herein by reference.

REFERENCE SIGNS LIST

11, 111: resin container, 21: upper surface portion, 22: side surface portion, 23: bottom surface portion, 24: inlet and outlet portion, 25: round corner surface portion, 28: shoulder portion, 30: recessed portion, 31, 131: first folding deformation inducing portion, 32, 132: second folding deformation inducing portion, 33, 133: third folding deformation inducing portion, 34, 134: fourth folding deformation inducing portion, 35, 135: fifth folding deformation inducing portion, 36, 136: sixth folding deformation inducing portion, 137: seventh folding deformation inducing portion, A: central axis

The invention claimed is:

1. A resin container for a water server, which is capable of accommodating a predetermined amount of liquid and has flexibility, the container being crushed with draining of the liquid, the container comprising:

an upper surface portion where a liquid inlet and outlet portion is formed;

a side surface portion connected to the upper surface portion; and a bottom surface portion disposed on a side opposite to the upper surface portion and connected to the side surface portion, wherein a round corner surface portion is formed to the side surface portion such that the container has a polygonal shape with round corners when the container is viewed from an upper surface portion side, wherein a wall thickness of a shoulder portion of the upper surface portion which is defined between the round corner surface portion of the side surface portion and the inlet and outlet portion is larger than a wall thickness of a portion of the upper surface portion which is adjacent to the shoulder portion, wherein the upper surface portion, which is adjacent to the shoulder portion, is positioned adjacently in a circumferential direction of the container when the container is viewed from the inlet and outlet portion, and wherein the wall thickness changes in the circumferential direction in a plane orthogonal to a central axis passing through the inlet and outlet portion of the resin container.

2. The resin container according to claim 1, wherein a wall thickness of a lower shoulder portion connecting the shoulder portion and the side surface portion is smaller than a wall thickness of a portion of the side surface portion which is adjacent to the lower shoulder portion.

3. The resin container according to claim 1, wherein a plurality of recessed portions radially extending from the inlet and outlet portion when the container is viewed from the upper surface portion side are formed on the upper surface portion.

4. The resin container according to claim 3, wherein a folding deformation inducing portion is formed on the round corner surface portion of the side surface portion, and wherein a depth of the recessed portion formed on the upper surface portion is deeper than a depth of a groove of the folding deformation inducing portion.

5. The resin container according to claim 2, wherein a plurality of recessed portions radially extending from the inlet and outlet portion when the container is viewed from the upper surface portion side are formed on the upper surface portion.

6. The resin container according to claim 5, wherein a folding deformation inducing portion is formed on the round corner surface portion of the side surface portion, and wherein a depth of the recessed portion formed on the upper surface portion is deeper than a depth of a groove of the folding deformation inducing portion.

* * * * *